US009353952B2

(12) United States Patent
Overby et al.

(10) Patent No.: US 9,353,952 B2
(45) Date of Patent: May 31, 2016

(54) CROSSFIRE TUBE ASSEMBLY WITH TUBE BIAS BETWEEN ADJACENT COMBUSTORS

(71) Applicant: General Electric Company, Schenectady, NY (US)

(72) Inventors: Brandon Taylor Overby, Spartanburg, SC (US); Keith Cletus Belsom, Laurens, SC (US); Jonathan Kay Allen, Simpsonville, SC (US); Kyle Eric Benson, Greenville, SC (US); Patrick Benedict Melton, Horse Shoe, NC (US); Richard Martin DiCintio, Simpsonville, SC (US); Lucas John Stoia, Taylors, SC (US); Ronnie Ray Pentecost, Travelers Rest, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 504 days.

(21) Appl. No.: 13/688,625

(22) Filed: Nov. 29, 2012

(65) Prior Publication Data

US 2014/0144122 A1 May 29, 2014

(51) Int. Cl.
*F23R 3/48* (2006.01)

(52) U.S. Cl.
CPC ..... *F23R 3/48* (2013.01)

(58) Field of Classification Search
CPC ..... F23R 3/48
See application file for complete search history.

(56) References Cited

U.S. PATENT DOCUMENTS

| | | | | | |
|---|---|---|---|---|---|
| 2,406,234 | A | * | 8/1946 | Marancik et al. | 285/96 |
| 2,437,385 | A | * | 3/1948 | Halford | 285/121.1 |
| 2,679,136 | A | * | 5/1954 | Gaubatz | 60/800 |
| 2,722,803 | A | * | 11/1955 | Travers | 60/39.37 |
| 2,818,704 | A | * | 1/1958 | Karcher | 60/790 |
| 2,832,195 | A | | 4/1958 | Weissborn, Jr. | |
| 3,344,601 | A | * | 10/1967 | Mieczkowski, Jr. | 60/800 |
| 3,492,030 | A | | 1/1970 | Harrison | |
| 3,650,106 | A | * | 3/1972 | Guillot | 60/748 |
| 3,991,560 | A | * | 11/1976 | DeCorso et al. | 60/800 |
| 4,249,372 | A | * | 2/1981 | White | 60/796 |
| 5,001,896 | A | | 3/1991 | Hilt et al. | |
| 5,154,049 | A | | 10/1992 | Ford et al. | |
| 5,219,256 | A | | 6/1993 | Ford et al. | |
| 5,361,577 | A | | 11/1994 | Cromer | |
| 5,402,635 | A | * | 4/1995 | Smith et al. | 60/39.37 |
| 5,407,237 | A | * | 4/1995 | Smolowitz | 285/31 |
| 5,603,531 | A | | 2/1997 | Maier | |
| 5,964,250 | A | * | 10/1999 | Mueller | 138/109 |
| 6,220,015 | B1 | | 4/2001 | Mina | |
| 6,334,294 | B1 | | 1/2002 | Belsom et al. | |

(Continued)

FOREIGN PATENT DOCUMENTS

JP S57142423 A 9/1982

OTHER PUBLICATIONS

Search Report from EP Application No. 13193750.0 dated Feb. 11, 2014.

*Primary Examiner* — Lorne Meade
(74) *Attorney, Agent, or Firm* — Dority & Manning, PA

(57) ABSTRACT

A crossfire tube assembly between adjacent combustors includes a first sleeve adapted to provide fluid communication from a first combustor and a second sleeve adapted to connect to provide fluid communication from a second combustor. The second sleeve extends at least partially inside the first sleeve. A bias is between the first and second sleeves.

15 Claims, 5 Drawing Sheets

(56) References Cited

U.S. PATENT DOCUMENTS

| | | | | |
|---|---|---|---|---|
| 6,606,865 | B2 | 8/2003 | Tilson et al. | |
| 6,705,088 | B2 | 3/2004 | Martling et al. | |
| 6,834,491 | B2 * | 12/2004 | Coppola | 60/39.37 |
| 6,912,838 | B2 * | 7/2005 | Sileo et al. | 60/39.37 |
| 7,712,302 | B2 | 5/2010 | Nichols et al. | |
| 8,220,246 | B2 | 7/2012 | Widener | |
| 2011/0067406 | A1 | 3/2011 | Widener | |
| 2014/0123619 | A1 * | 5/2014 | DiCintio | 60/39.37 |
| 2014/0137536 | A1 * | 5/2014 | Cloninger et al. | 60/39.37 |

* cited by examiner

CROSSFIRE TUBE ASSEMBLY WITH TUBE BIAS BETWEEN ADJACENT COMBUSTORS

FIELD OF THE INVENTION

The present invention generally involves a crossfire tube assembly between adjacent combustors.

BACKGROUND OF THE INVENTION

Gas turbines are widely used in industrial and commercial operations. A typical gas turbine includes an inlet section, a compressor section, a combustion section, a turbine section, and an exhaust section. The inlet section cleans and conditions a working fluid (e.g., air) and supplies the working fluid to the compressor section. The compressor section increases the pressure of the working fluid and supplies a compressed working fluid to the combustion section. The combustion section mixes fuel with the compressed working fluid and ignites the mixture to generate combustion gases having a high temperature and pressure. The combustion gases flow to the turbine section where they expand to produce work. For example, expansion of the combustion gases in the turbine section may rotate a shaft connected to a generator to produce electricity.

The combustion section typically includes multiple combustors annularly arranged between the compressor section and the turbine section. A casing generally surrounds each combustor to contain the compressed working fluid flowing to each combustor, and one or more nozzles supply fuel to mix with the compressed working fluid before the mixture flows into a combustion chamber downstream from the nozzles. A liner circumferentially surrounds the combustion chamber to define at least a portion of the combustion chamber, and a flow sleeve may circumferentially surround at least a portion of the liner to define an annular plenum between the flow sleeve and liner through which the compressed working fluid may flow before entering the combustion chamber. An ignition device, such as a spark plug, may be used to initiate combustion in one combustion chamber, and one or more crossfire or crossover ignition tubes may be used to spread the combustion to adjacent combustors. For example, a crossfire tube may extend through the liner, flow sleeve, and casing of adjacent combustors to allow the combustion in one combustor to propagate to the adjacent combustor.

Although the crossfire tubes are effective at propagating combustion between adjacent combustors, the assembly and/or location of the crossfire tubes may have one or more disadvantages. For example, installation and removal of the crossfire tubes may result in damage to retention clips or other clamps used to hold the crossfire tubes in place. In addition, the crossfire tubes may create flow instabilities of the compressed working fluid flowing around the crossfire tubes in the annular plenum between the flow sleeve and the liner. In some combustor designs, fuel may be supplied through quaternary ports located between the crossfire tubes and the nozzles, and the flow instabilities around the crossfire tubes may create backflow regions that may draw burnable mixtures of fuel back toward the crossfire tubes, creating conditions more conducive to a flame holding event. Therefore, an improved crossfire tube assembly that addressed one or more of these concerns would be useful.

BRIEF DESCRIPTION OF THE INVENTION

Aspects and advantages of the invention are set forth below in the following description, or may be obvious from the description, or may be learned through practice of the invention.

One embodiment of the present invention is a crossfire tube assembly between adjacent combustors that includes a first sleeve adapted to provide fluid communication from a first combustor and a second sleeve adapted to connect to provide fluid communication from a second combustor. The second sleeve extends at least partially inside the first sleeve. A bias is between the first and second sleeves.

Another embodiment of the present invention is a crossfire tube assembly between adjacent combustors that includes a telescoping sleeve. The telescoping sleeve has a first end adapted to provide fluid communication from a first combustor and a second end adapted to provide fluid communication from a second combustor. The crossfire tube assembly further includes means for separating the first end from the second end.

In yet another embodiment, a gas turbine may include a compressor, a plurality of combustors downstream from the compressor, and a turbine downstream from the plurality of combustors. A first sleeve is adapted to provide fluid communication from a first combustor, and a second sleeve is adapted to provide fluid communication from a second combustor. The second sleeve extends at least partially inside the first sleeve, and a bias is engaged with the first and second sleeves.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
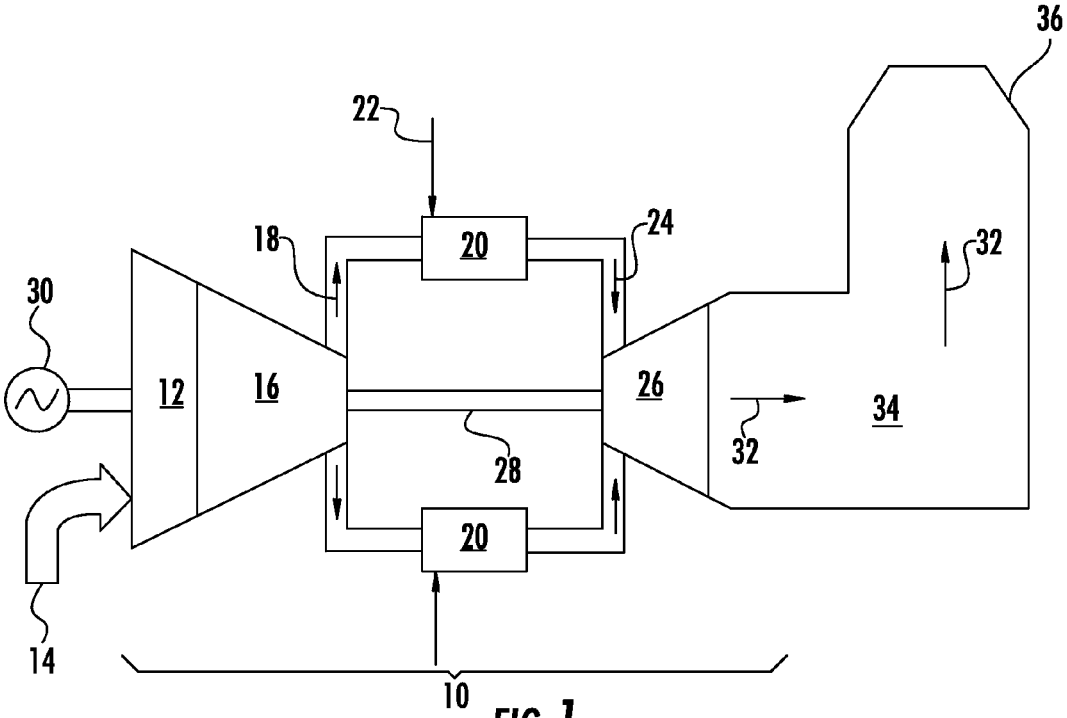
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows, and "downstream" refers to the direction to which the fluid flows. Similarly, "radially" refers to the relative direction substantially perpendicular to the fluid flow, and "axially" refers to the relative direction substantially parallel to the fluid flow.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a crossfire tube assembly for a gas turbine that generally includes an extendable or telescoping sleeve between adjacent combustors. The telescoping sleeve may include first and second sleeves or ends adapted to provide fluid communication between the adjacent combustors, and a bias or other means may separate the first sleeve or end from the second sleeve or end. In particular embodiments, the bias or other means may be a compression spring and/or may circumferentially surround at least a portion of the first and/or second sleeves or ends. In other particular embodiments, the telescoping sleeve may define a slot, and the bias or other means may extend at least partially inside the slot. In this manner, the telescoping sleeve may define a sealed passage between the adjacent combustors to allow combustion in one combustor to propagate to the adjacent combustor. Although exemplary embodiments of the present invention may be described and illustrated generally in the context of a gas turbine, one of ordinary skill in the art will readily appreciate from the teachings herein that embodiments of the present invention may be used with combustors incorporated into other turbo-machines, and the present invention is not limited to gas turbines unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state. The compressed working fluid 18 flows to a combustion section where one or more combustors 20 ignite fuel 22 with the compressed working fluid 18 to produce combustion gases 24 having a high temperature and pressure. The combustion gases 24 flow through a turbine section to produce work. For example, a turbine 26 may connect to a shaft 28 so that rotation of the turbine 26 drives the compressor 16 to produce the compressed working fluid 18. Alternately or in addition, the shaft 28 may connect the turbine 26 to a generator 30 for producing electricity. Exhaust gases 32 from the turbine 26 flow through an exhaust section 34 that may connect the turbine 26 to an exhaust stack 36 downstream from the turbine 26. The exhaust section 34 may include, for example, a heat recovery steam generator (not shown) for cleaning and extracting additional heat from the exhaust gases 32 prior to release to the environment.

Figure 2:
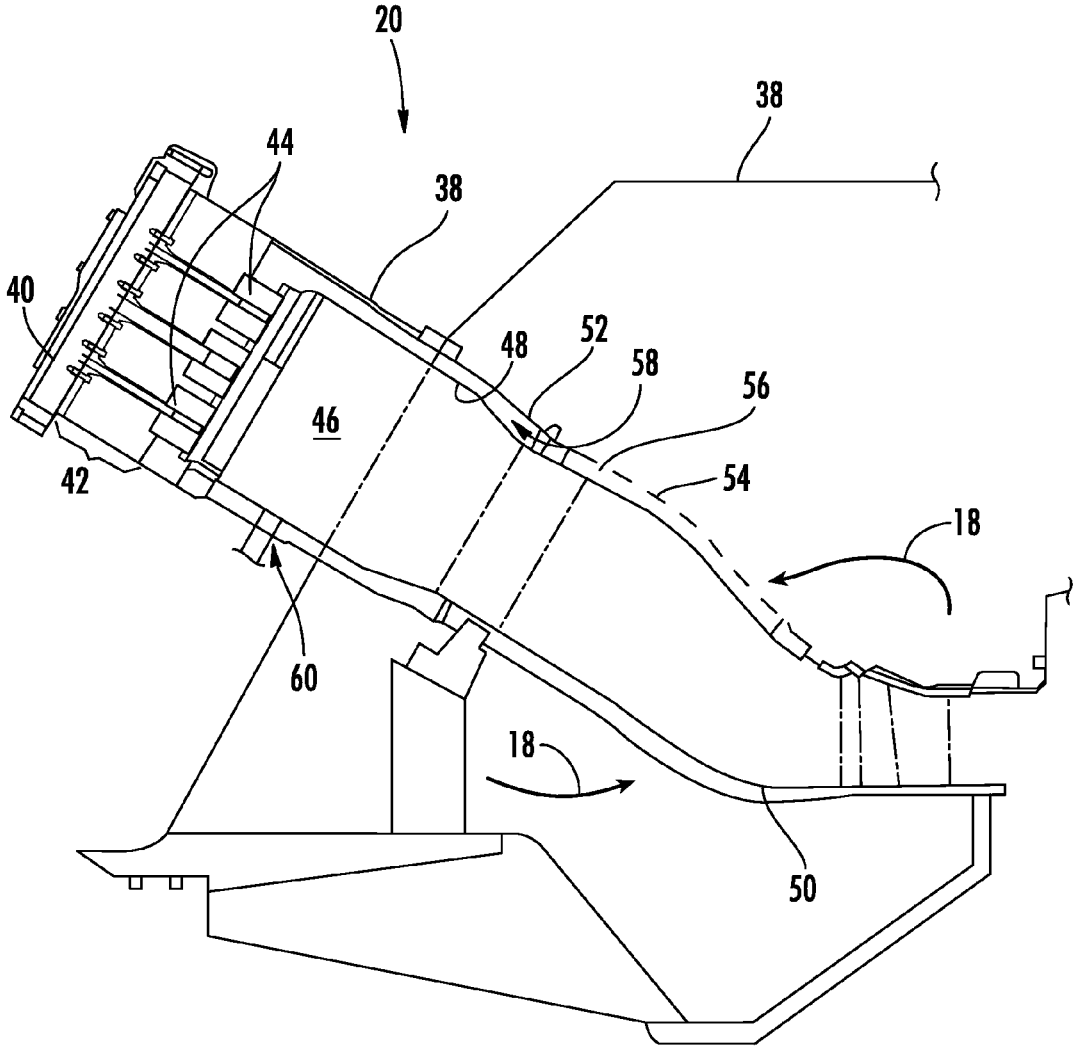
FIG. 2 is a simplified side cross-section view of an exemplary combustor according to various embodiments of the present invention.

The combustors 20 may be any type of combustor known in the art, and the present invention is not limited to any particular combustor design unless specifically recited in the claims. FIG. 2 provides a simplified side cross-section view of an exemplary combustor 20 according to various embodiments of the present invention. A combustor casing 38 circumferentially surrounds at least a portion of the combustor 20 to contain the compressed working fluid 18 flowing from the compressor 16. As shown in FIG. 2, the combustor casing 38 may be connected to or include an end cover 40 that extends radially across at least a portion of each combustor 20. The combustor casing 38 and end cover 40 may combine to at least partially define a head end volume 42 inside each combustor 20. One or more nozzles 44 may be radially arranged in the end cover 40 to supply fuel 22, diluent, and/or other additives to a combustion chamber 46 downstream from the head end volume 42. Possible fuels 22 may include, for example, blast furnace gas, coke oven gas, natural gas, methane, vaporized liquefied natural gas (LNG), hydrogen, syngas, butane, propane, olefins, diesel, petroleum distillates, and combinations thereof. A liner 48 may circumferentially surround at least a portion of the combustion chamber 46, and a transition piece 50 downstream from the liner 48 may connect the combustor 20 to the turbine 26.

A flow sleeve 52 may circumferentially surround at least a portion of the liner 48, and an impingement sleeve 54 with flow holes 56 may circumferentially surround at least a portion of the transition piece 50. The flow sleeve 52 and impingement sleeve 54 combine to define an annular plenum 58 around the liner 48 and impingement sleeve 54. In this manner, the compressed working fluid 18 from the compressor 16 may flow through the flow holes 56 in the impingement sleeve 54 and along the outside of the transition piece 50 and liner 48 to provide convective and/or conductive cooling to the transition piece 50 and liner 48. When the compressed working fluid 18 reaches the head end volume 42, the compressed working fluid 18 reverses direction to flow through the nozzles 44 and into the combustion chamber 46.

Figure 3:
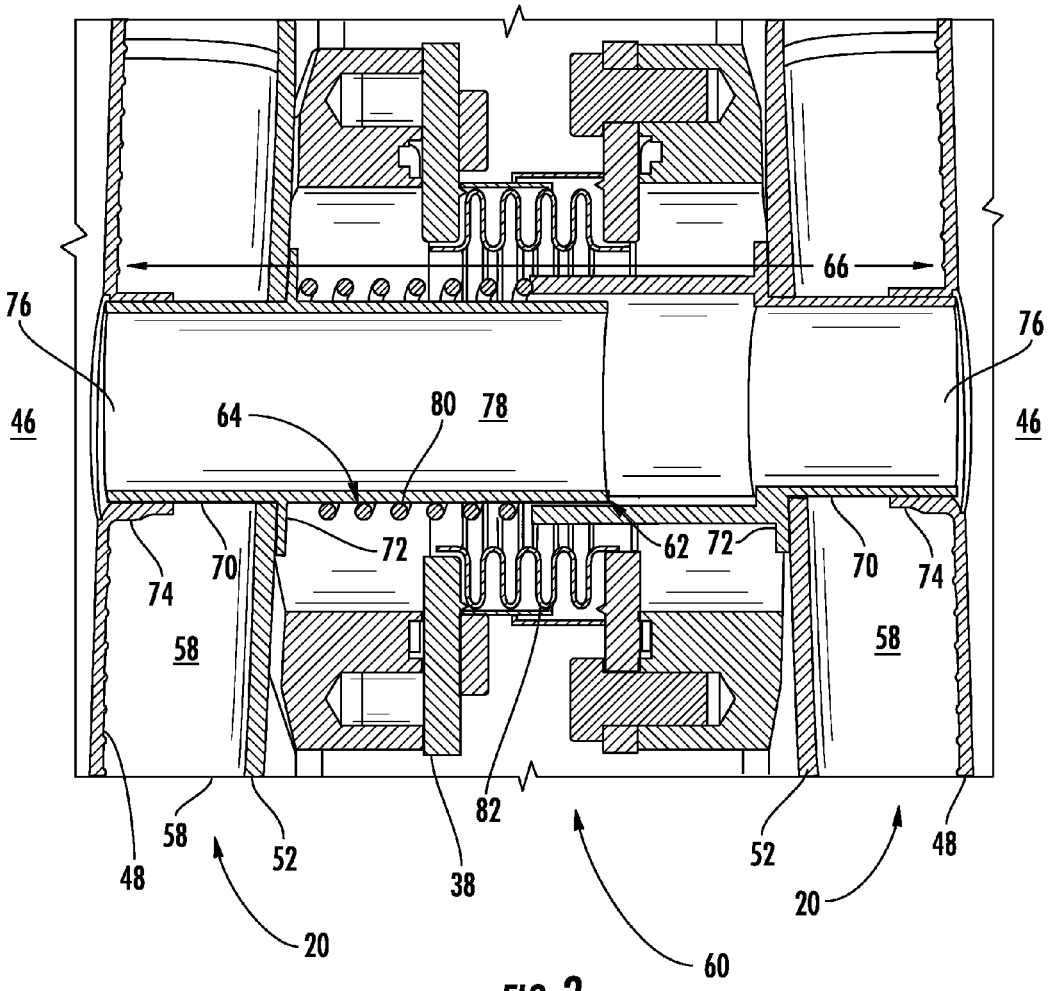
FIG. 3 is a plan view of a crossfire tube assembly according to one embodiment of the present invention.
Figure 4:
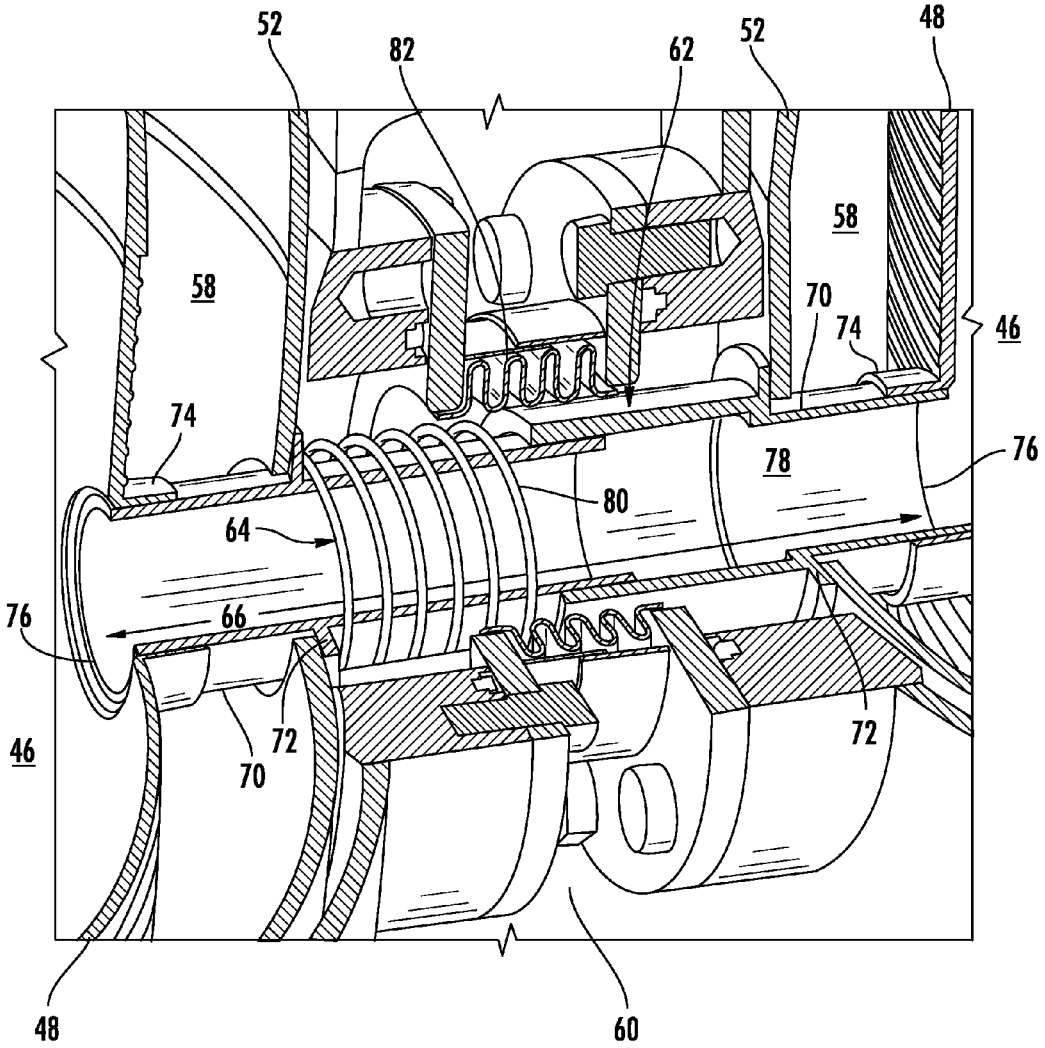
FIG. 4 is a perspective view of the crossfire tube assembly shown in FIG. 3.

As shown in FIG. 2, the combustor 20 further includes a crossfire tube assembly 60, and FIGS. 3 and 4 provide plan and perspective views of the crossfire tube assembly 60 between adjacent combustors 20 according to one embodiment of the present invention. As shown in FIGS. 3 and 4, the crossfire tube assembly 60 generally includes an extendable or telescoping sleeve 62 with a bias 64 or other means for varying a length 66 of the telescoping sleeve 62. The telescoping sleeve 62 provides fluid communication between combustion chambers 46 in adjacent combustors 20 to allow combustion in one combustor 20 to readily propagate to the adjacent combustor 20. Although generally illustrated as a cylindrical tube, one of ordinary skill in the art should readily appreciate that the telescoping sleeve 62 may have any geometric cross-section. In the particular embodiment shown in FIGS. 3 and 4, the telescoping sleeve 62 generally includes a separate sleeve 70 adapted to connect to each adjacent combustor 20, and the sleeves 70 may be in sliding engagement with one another. For example, each sleeve 70 may extend through the casing 38, flow sleeve 52, and annular passage 58 of each combustor 20. In particular embodiments, the sleeve 70 may include a flange 72 or other detent to locate the sleeve 70 against the flow sleeve 52. A boss 74 may locate an end 76 of the sleeve 70 at a desired location on the liner 48. The end 76 of the sleeve may slide inside or outside of the boss 74 to provide fluid communication from the combustion chamber 46 into the sleeve 70. In particular embodiments, the flange 72 may be welded or otherwise connected to the flow sleeve 52 and/or the end 76 may be welded or otherwise connected to the boss 74 and/or liner 48. In this manner, the telescoping sleeve 62 may define a sealed passage 78 between the adjacent combustors 20 to reduce or prevent the compressed working fluid 18 from leaking into the telescoping sleeve 62 and/or the combustion gases 24 from leaking out of the telescoping sleeve 62.

The bias 64 or other means for separating the ends 76 of the sleeves 70 adjusts the length 66 of the telescoping sleeve 62 to accommodate varying distances and/or vibrations between the adjacent combustors 20. In the particular embodiment shown in FIGS. 3 and 4, the bias 64 is a compression spring 80 that circumferentially surrounds at least a portion of one of the sleeves 70 and is engaged between the opposing sleeves 70. In this manner the compression spring 80 biases the opposing sleeves 70 and ends 76 away from one another to positively seat the flanges 72 against the respective flow sleeves 52. In other particular embodiments, the structure for separating the ends 76 of the sleeves 70 may include a compression bellows, coil, clutch, or other mechanical device known to one of ordinary skill in the art for separating components.

As shown in FIGS. 3 and 4, the crossfire tube assembly 60 may further include a bellows 82 that circumferentially surrounds at least a portion of the telescoping sleeve 62. Opposite ends 84 of the bellows 82 may welded or otherwise connected to the casing 38 of the adjacent combustors 20 so that the bellows 82 may provide an expandable barrier between the casing 38 of the adjacent combustors 20.

Figure 5:
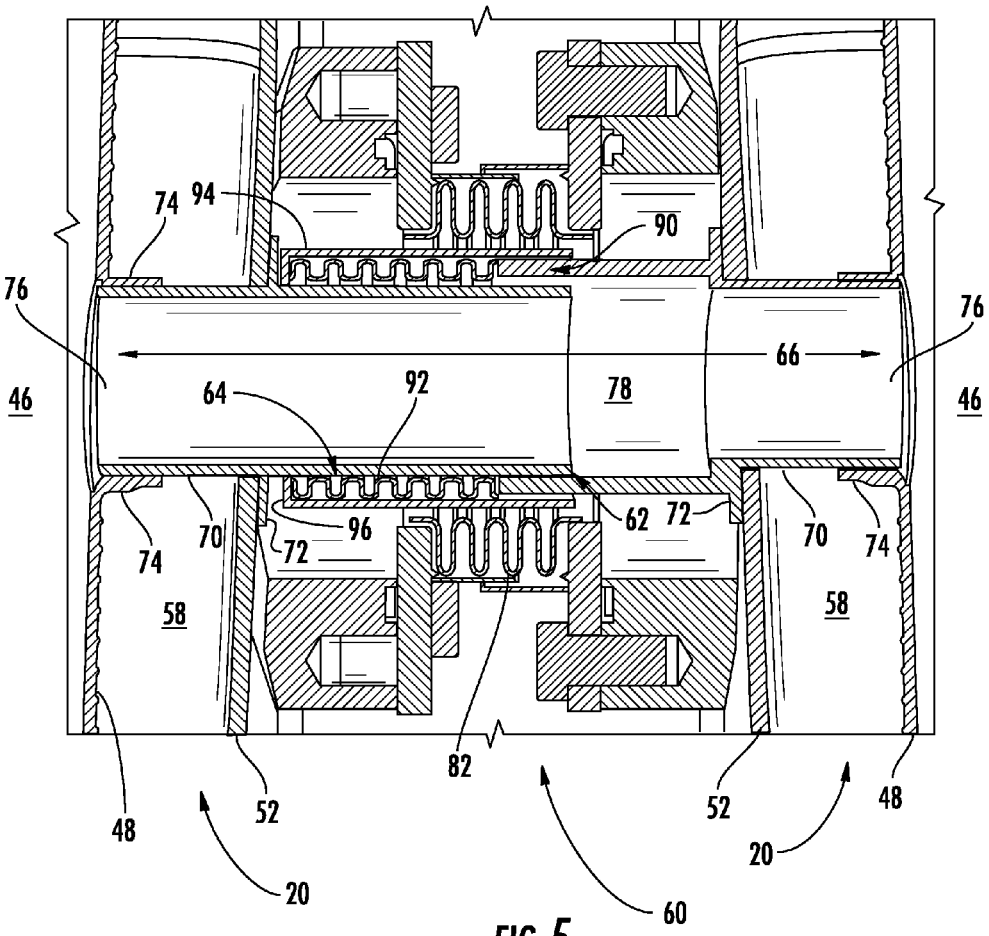
FIG. 5 is a plan view of a crossfire tube assembly according to an alternate embodiment of the present invention.

FIG. 5 provides a plan view of the crossfire tube assembly 60 according to an alternate embodiment of the present invention. In this particular embodiment, the crossfire tube assembly 60 again includes the telescoping sleeve 62, sleeves 70, flanges 72, ends 76, and bellows 82 as previously described with respect to the embodiment shown in FIGS. 3 and 4. In addition, an outer sleeve 94 circumferentially surrounds and is radially spaced from a portion of the telescoping sleeve 62 defining an annular slot 90 between the outer sleeve 94 and the portion of the telescoping sleeve 62, and the other sleeve 70 extends at least partially inside the annular slot 90. The outer sleeve 94 includes a radially inward flanged end 96 that is directly connected to the telescoping sleeve 62. In addition, the means for separating the ends 76 of the sleeves 70 is a compression bellows 92 that extends at least partially inside the annular slot 90. In this manner, the annular slot 90 enhances the sliding engagement between the opposing sleeves 70 and/or encloses the bias 64 or other means from direct exposure to the surrounding compressed working fluid 18 and/or combustion gases 24.

One of ordinary skill in the art will readily appreciate from the teachings herein that the embodiments of the crossfire tube assembly 60 shown in FIGS. 1-5 facilitate easier installation and/or removal of the telescoping sleeve 62 compared to previous embodiments. Specifically, the bias 64 or other means for separating the ends 76 obviates the need for retention clips or other clamps used to hold other crossfire tubes in place. In addition, the unobstructed profile of the sleeves 70 in the annular plenums 58 reduces flow instabilities of the compressed working fluid 18 flowing around the sleeves 70 in the annular plenums 58, reducing or eliminating undesired wakes and/or recirculation zones downstream from the sleeves 70. This benefits the operation of the combustor 20 by reducing the pressure drop caused by the sleeves 70 and/or reducing conditions conducive to flame holding in the annular plenums 58. As a result, the crossfire tube assemblies 60 shown in FIGS. 1-5 should improve operability and reliability of the combustors 20 and gas turbine 10 by reducing maintenance and unscheduled outages associated with the crossfire tubes and/or trips or forced outages associated with flame holding events.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A crossfire tube assembly between adjacent combustors, the crossfire tube assembly comprising:

a. a first sleeve adapted to provide fluid communication from a first combustor;

b. an outer sleeve that circumferentially surrounds a portion of said first sleeve, where said outer sleeve includes a radially inward flanged end that is directly connected to said first sleeve, wherein said outer sleeve is radially spaced from said first sleeve to define an annular slot therebetween;

c. a second sleeve adapted to provide fluid communication from a second combustor, wherein said second sleeve extends at least partially inside said annular slot; and d. a bias enclosed entirely within said annular slot and extending axially between said radially inward flanged end and said second sleeve, wherein said bias is connected at one end to an end portion of said second sleeve, wherein said end portion of said second sleeve is disposed within said slot.

2. The crossfire tube assembly as in claim 1, wherein said bias comprises a compression spring.

3. The crossfire tube assembly as in claim 1, wherein said bias circumferentially surrounds at least a portion of said first sleeves.

4. The crossfire tube assembly as in claim 1, wherein said first sleeve is adapted to extend through a flow sleeve in the first combustor.

5. The crossfire tube assembly as in claim 1, wherein said bias comprises a bellows.

6. The crossfire tube assembly as in claim 1, wherein said first and second sleeves define a sealed passage between the first and second combustors.

7. The crossfire tube assembly as in claim 1, further comprising a bellows that circumferentially surrounds at least a portion of said first and second sleeves.

8. A gas turbine, comprising:

a. a compressor;

b. a plurality of combustors downstream from said compressor;

c. a turbine downstream from said plurality of combustors;

d. a first sleeve adapted to provide fluid communication from a first combustor of the plurality of combustors;

e. an outer sleeve that circumferentially surrounds a portion of said first sleeve, where said outer sleeve includes a radially inward flanged end that is directly connected to said first sleeve, wherein said outer sleeve is radially spaced from said first sleeve to define an annular slot therebetween;

f. a second sleeve adapted to provide fluid communication from a second combustor of the plurality of combustors, wherein said second sleeve extends at least partially inside said annular slot; and g. a bias engaged at a first end with said radially inward flanged end of said outer sleeve, said bias engaged at a second end with said second sleeve, said bias being enclosed entirety within said annular slot and extending axially between said radially inward flanged end and said second sleeve.

9. The gas turbine as in claim 8, wherein said bias circumferentially surrounds at least a portion of said first sleeves.

10. The gas turbine as in claim 8, wherein said first and second sleeves define a sealed passage between the first and second combustors.

11. The gas turbine as in claim 8, further comprising a bellows that circumferentially surrounds at least a portion of said first sleeve and said outer sleeve, wherein said bellows extends from said first combustor to said second combustor.

12. The gas turbine as in claim 11, wherein said bellows forms a seal between said first combustor and said second combustor.

13. The gas turbine as in claim 8, wherein said bias comprises a compression spring.

14. The gas turbine as in claim 8, wherein said bias comprises a bellows.

15. The gas turbine as in claim 8, wherein said first sleeve is adapted to extend through a flow sleeve in the first combustor and said second sleeve is adapted to extend through a flow sleeve in the second combustor.

* * * * *